US009476298B2

(12) United States Patent
McCoy

(10) Patent No.: US 9,476,298 B2
(45) Date of Patent: Oct. 25, 2016

(54) CONTINUOUS MINING MACHINE HAVING CORE CUTTING ASSEMBLY

(71) Applicant: Caterpillar Global Mining America LLC, Houston, PA (US)

(72) Inventor: Gregory Allen McCoy, Washington, PA (US)

(73) Assignee: Caterpillar Global Mining America LLC, Houston, PA (US)

( * ) Notice: Subject to any disclaimer, the term of this patent is extended or adjusted under 35 U.S.C. 154(b) by 37 days.

(21) Appl. No.: 14/507,424

(22) Filed: Oct. 6, 2014

(65) Prior Publication Data

US 2016/0097276 A1 Apr. 7, 2016

(51) Int. Cl.

| | |
|---|---|
| ***E21C 27/24*** | (2006.01) |
| ***E21C 35/00*** | (2006.01) |
| ***E21C 25/52*** | (2006.01) |
| ***E21C 27/12*** | (2006.01) |
| ***E21C 31/02*** | (2006.01) |
| ***E21C 31/12*** | (2006.01) |

(52) U.S. Cl.

CPC ..... *E21C 25/52* (2013.01); *E21C 27/128* (2013.01); *E21C 27/24* (2013.01); *E21C 31/02* (2013.01); *E21C 31/12* (2013.01); *E21C 35/00* (2013.01)

(58) Field of Classification Search

CPC ..... E21C 25/10; E21C 27/24; E21C 35/00

USPC ..... 299/78, 79.1, 95, 101

See application file for complete search history.

(56) References Cited

U.S. PATENT DOCUMENTS

| | | | | |
|---|---|---|---|---|
| 3,010,708 | A | 11/1951 | Hlinsky et al. | |
| 2,623,025 | A | 2/1958 | Biedess | |
| 2,986,384 | A | 5/1961 | Densmore | |
| 3,008,698 | A | 11/1961 | Risse et al. | |
| 3,050,292 | A | 8/1962 | Newton et al. | |
| 3,064,958 | A | 11/1962 | Osgood | |
| 3,279,856 | A | 10/1966 | Silks | |
| 5,143,423 | A * | 9/1992 | LeBegue | E21C 25/10 299/76 |
| 5,964,507 | A * | 10/1999 | Blackstock | E21C 25/10 299/76 |
| 8,511,757 | B2 | 8/2013 | O'Neill | |
| 2014/0084667 | A1* | 3/2014 | Rowher | B28D 1/18 299/55 |
| 2014/0091612 | A1* | 4/2014 | Rowher | E21C 27/24 299/10 |
| 2014/0232168 | A1* | 8/2014 | Muller | B28D 1/18 299/1.4 |
| 2015/0204190 | A1* | 7/2015 | Krings | E21D 9/1026 299/10 |

FOREIGN PATENT DOCUMENTS

WO WO2012/156841 A2 * 11/2012

OTHER PUBLICATIONS

"CAT Rock Straight System Fully Mechanized Longwall System for Hard Rock Production", AEHJ0169, © 2014 Caterpillar Inc.

* cited by examiner

*Primary Examiner* — John Kreck
*Assistant Examiner* — Michael Goodwin

(57) ABSTRACT

A core cutting assembly is disclosed for use with a continuous mining machine having a milling drum. The core cutting assembly may have a drive mechanism configured to rotate about a first axis of the milling drum. The core cutting assembly may also have at least one rotary cutting bit powered by the drive mechanism to rotate about a second axis that is substantially orthogonal to the first axis.

20 Claims, 3 Drawing Sheets

CONTINUOUS MINING MACHINE HAVING CORE CUTTING ASSEMBLY

TECHNICAL FIELD

The present disclosure relates generally to a continuous mining machine, and more particularly, to a continuous mining machine having a core cutting assembly.

BACKGROUND

A drum continuous miner (CM) is a machine used for underground mining of ore seams. A typical CM includes a frame propelled by tracked drive units. The frame supports a power source (e.g., an electric motor) and a milling drum. The milling drum, fitted with cutting tools, is rotated through a suitable interface by the power source to break up an exposed surface of the ore seam. The broken up material is deposited by the milling drum onto a conveyor for removal from an underside of the CM to a rear end of the CM. The material is then transferred from the conveyor into a nearby haul vehicle for transportation away from the worksite.

The milling drum is generally supported at spaced apart locations by vertically oriented struts. In particular, the milling drum can be divided into three or five different segments, with a strut located between adjacent segments. The struts vertically support the milling drum, and also provide a way to drive the milling drum. For example, a shaft, a belt, or a chain can pass from the electric motor through the strut to the milling drum, thereby engaging an end of each drum segment to rotate the drum. Because the cutting surface of the milling drum is segmented at the struts, a vertical core of unmilled material may be left at each strut location. These cores, if left intact, can inhibit further penetration of the CM into the ore material. Accordingly, the cores must be periodically broken off and moved out of the way of the struts.

An exemplary continuous mining machine is disclosed in U.S. Pat. No. 8,511,757 of O'Neill that issued on Aug. 20, 2013 ("the '757 patent"). Specifically, the '757 patent discloses a mining machine having a core breaker. The core breaker is positioned between the cutting drums of the mining machine, and includes a circular beveled blade having a plurality of bits that can break the core material into fragments. The beveled blade is forced into the core material by forward motion of the mining machine. By breaking the core material into fragments, the barrier to further penetration of the milling drum into the ore seam is eliminated.

Although the core breaker of the '757 patent may be beneficial in removing the vertical core left between adjacent segments of a milling drum, the core breaker may be less than optimal. In particular, a force necessary to push the core breaker into the material core may be significant, requiring the mining machine to be large and heavy and to have an engine or motor with significant power. A large, heavy mining machine may be inefficient, and the size of the engine or motor required to move the machine may have poor efficiency and be expensive to purchase and to operate.

The disclosed mining machine and core cutting assembly may be directed at overcoming one or more of the problems set forth above and/or other problems in the prior art.

SUMMARY

One aspect of the present disclosure is directed to a core cutting assembly for a continuous mining machine having a milling drum. The core cutting assembly may include a drive mechanism configured to rotate about a first axis of the milling drum. The core cutting assembly may also include at least one rotary cutting bit powered by the drive mechanism to rotate about a second axis that is substantially orthogonal to the first axis.

Another aspect of the present disclosure is directed to a milling system for a continuous mining machine. The milling system may include a milling drum, a plurality of cutting tools mounted to an outer cylindrical surface of the milling drum, and a strut supporting the milling drum. The milling system may also include a shaft connected to rotate the milling drum about a first axis, and a drive mechanism connected to the shaft at an end of the milling drum. The milling system may further include at least one rotary cutting bit supported by the strut and powered by the drive mechanism to rotate about a second axis that is substantially orthogonal to the first axis.

Yet another aspect of the present disclosure is direct to a continuous mining machine. The continuous mining machine may include a frame, a mobile undercarriage supporting the frame, and a boom pivotally connected to the frame. The continuous mining machine may further include a milling drum having an outer cylindrical surface divided into a plurality of segments, and a plurality of cutting tools mounted to each of the plurality of segments. The continuous mining machine may also include a strut connecting the milling drum to a distal end of the boom, a shaft configured to drive the milling drum about a first axis, and a drive mechanism mounted to the strut and driven by the shaft to rotate about the first axis of the milling drum. The continuous mining machine may additionally include a plurality of rotary cutting bits arranged within a common plane, supported by the strut in a forward driving direction of the mining machine, and powered by the drive mechanism to rotate about a second axis that is substantially orthogonal to the first axis.

DETAILED DESCRIPTION

Figure 1:
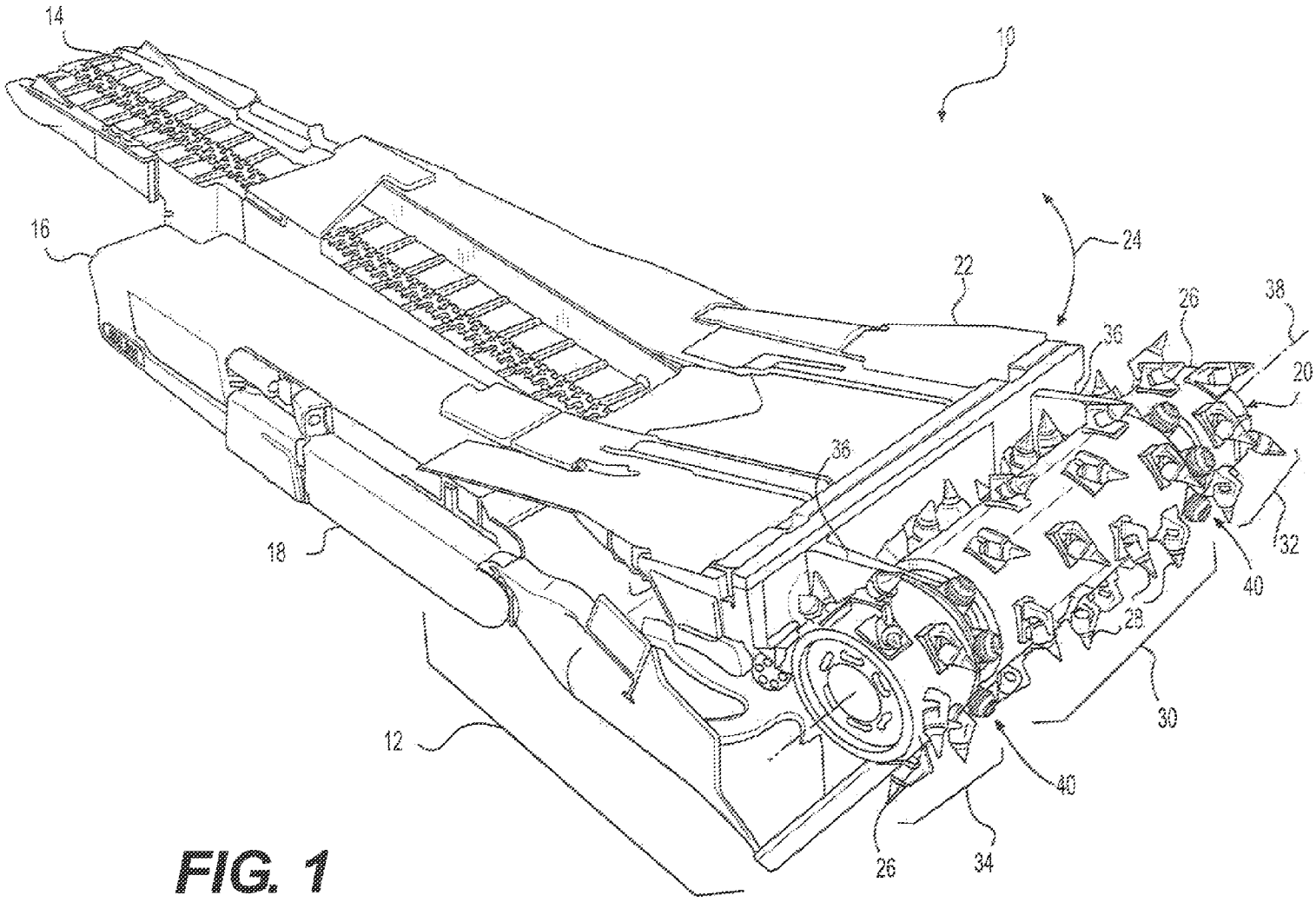
FIG. 1 is an isometric illustration of an exemplary continuous mining machine.

FIG. 1 illustrates an exemplary continuous mining machine (CM) 10 equipped with a milling system 12 at a forward end forward relative to a normal travel direction). Milling system 12 may be a drum-type system configured to continuously mill material from an ore seam. The milled material may be deposited onto a conveyor belt 14 for transportation to a rear end of CM 10. Milling system 12 and conveyor belt 14 may both be supported by a frame 16 of CM 10. Frame 16 may be mounted to a mobile undercarriage 18, and a power source (e.g., an electric motor or an internal combustion engine—not shown) may be connected to frame 16 to drive milling system 12 and undercarriage 18. The power source may be directly mounted to frame 16, or indirectly connected to frame 16 via a tether, as desired.

Milling system 12 may be configured to engage and fragment the ore seam at a location forward of and above CM 10. In particular, milling system 12 may include, among other things, a milling drum 20 that is rotatably connected to frame 16 by way of a boom 22. Boom 22 may be configured to selectively raise and lower milling drum 20 along an arcuate trajectory 24, allowing milling drum 20 to engage a front wall and/or a ceiling of a mining tunnel in which CM 10 is operating.

Milling drum 20 may be divided into multiple drum segments, each segment having an outer surface 26 to which a plurality of cutting tools 28 are attached. In the disclosed embodiment, milling drum 20 is shown as being divided into three segments, including a center segment 30, and left- and right-side segments 32, 34, respectively. It is contemplated that milling drum 20 may be divided into any number of segments, or not divided at all.

Milling drum 20 may be connected to boom 22 by way of one or more struts 36. In the disclosed embodiment having three drum segments, one strut 36 is shown as being located between each pairing of adjacent segments. That is, milling drum 20 shown in FIG. 1 may include two generally mid-located struts 36. It is contemplated, however, that in other embodiments, any appropriate number of struts 36 may be included. Struts 36 may be structural members configured to support milling drum 20.

In some embodiments, a connection between the power source of CM 10 and milling drum 20 may pass through one or more of struts 36. For example, one or more of struts 36 may be hollow or recessed, and the corresponding connection (e.g., a shaft connection, a belt connection, a chain connection, etc.) may be located within (e.g., pass through) the hollow or recessed portion of strut 36 to connect with milling drum 20. This connection may result in rotation of milling drum 20 about a longitudinal axis 38. It may be possible for the power connection to be located away from strut 36 in some applications.

Cutting tools 28 may be angled relative to a circumferential direction of milling drum 20. For example, cutting tools 28 may be skewed toward ends of the corresponding drum segments. In this configuration, tips of the cutting tools 28 located closest (e.g., immediately adjacent) to struts 36 may axially overhang struts 36 a distance. This overhang may reduce a width of a material core located at struts 36 that is not fragmented by cutting tools 28.

Figure 3:
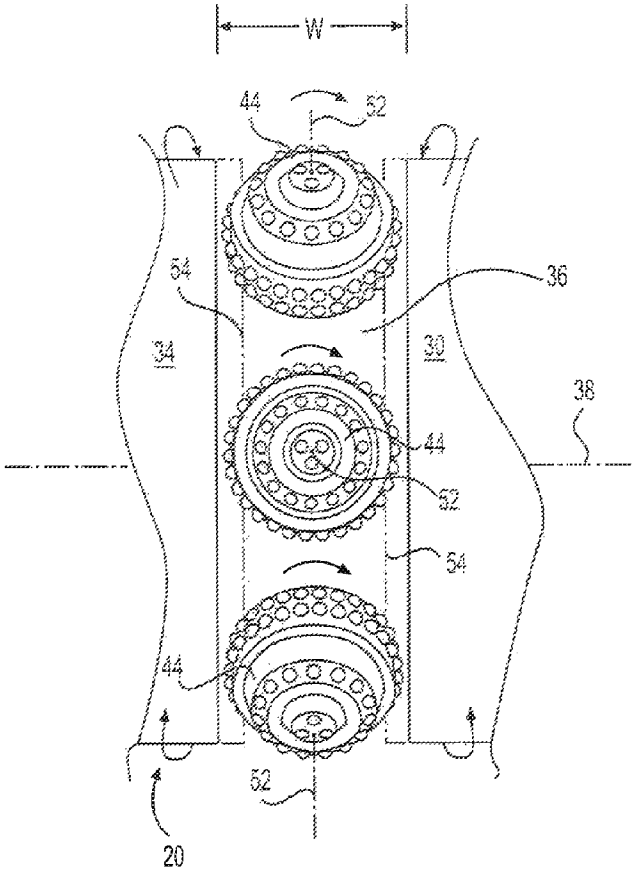
FIGS. 2 and 3 are cutaway side and isometric front view illustrations, respectively, of an exemplary core cutting assembly that may be used in conjunction with the continuous mining machine of FIG. 1.
Figure 2:
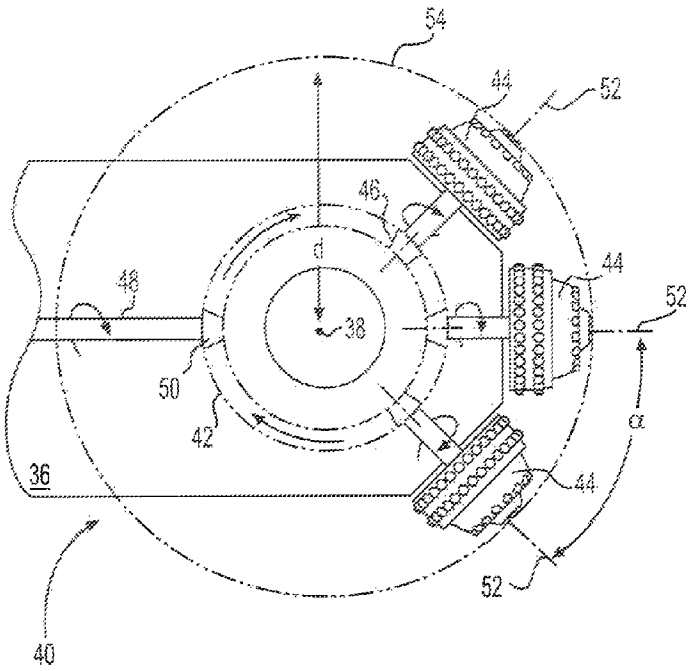

Milling system 12 may additionally include a core cutting assembly 40 configured to fragment the material core not removed by cutting tools 28 at each strut location. An exemplary core cutting assembly 40 is shown in FIGS. 2 and 3. As depicted in these figures, core cutting assembly 40 may include a drive mechanism 42 configured to power one or more rotary core cutting bits (bits) 44. In this example, drive mechanism 42 is a ring gear connected to each bit 44 by way of a pinion gear 46. It is contemplated, however, that drive mechanism 42 could embody a different type of device, if desired.

Drive mechanism 42 may be connected to the power source of CM 10 by way of a shaft 48. For example, shaft 48 could include a pinion gear 50 that intermeshes with the ring gear of drive mechanism 42. In one embodiment, shaft 48 is the same shaft that also drives the rotation of milling drum 20, and the ring gear of drive mechanism 42 may be concentric with milling drum 20 to rotate about the same longitudinal axis 38. In another embodiment, shaft 48 may be separate from the shaft that drives the rotation of milling drum 20.

Rotary cutting bits 44 may be oriented to each rotate about a personal axis 52 that passes through and is substantially orthogonal (e.g., orthogonal within about +/−5°) to longitudinal axis 38. The rotary cutting bits 44 are connected to and supported by the strut 36 such that each remains in a fixed position relative to the milling drum longitudinal axis 38. In the depicted example, three rotary cutting bits 44 are shown as all being generally aligned in the same plane. That is, the axis 52 of each rotary cutting bit 44 may generally lie in the same plane (see FIG. 3). Each rotary cutting bit 44 may be spaced apart from an adjacent rotary cutting bit 44 by an angle $\alpha$. In the example of FIG. 2, angle $\alpha$ is about 45°, although other configurations (e.g., narrower spacing with a different number of cutting bits 44) may also be possible. Axis 52 of the center-most one of rotary cutting bits 44 may be generally aligned with the normal travel direction of CM 10, when boom 22 (referring to FIG. 1) is at its most retracted or lowest position.

As also shown in FIG. 2, a distal end of each rotary cutting bit 44 may be located at about the same radial distance d away from longitudinal axis 38. In an exemplary application, this distance d may correspond with a radial tip location of each of cutting tools 28 (represented by a dashed circle 54 in FIG. 2). In other words, rotary cutting bits 44 may extend radially outward as least as far as a tip diameter of cutting tools 28, such that rotary cutting bits 44 engage the tunnel wall and/or ceiling at about the same time that cutting tools 28 engage these surfaces.

In addition, each rotary cutting bit 44 may have a diameter about equal to or larger than a width w (shown in FIG. 3) of the associated strut 36. With this arrangement, rotary cutting bits 44 may be able to completely remove core material that might otherwise block forward movement of struts 36. It is contemplated, however, that rotary cutting bit 44 could have a diameter that is less than the width w of strut 36, if desired. In some embodiments, the skew of cutting tools 28 (referring to FIG. 1) may result in the distal tip ends of cutting tools 28 overlapping rotary cutting bits 44 at both opposing sides (shown with dashed lines 54 in FIG. 3). In these embodiments, cutting tools 28, together with rotary cutting bits 44, may be able to completely remove any core of material normally left behind at struts 36.

Figure 4:
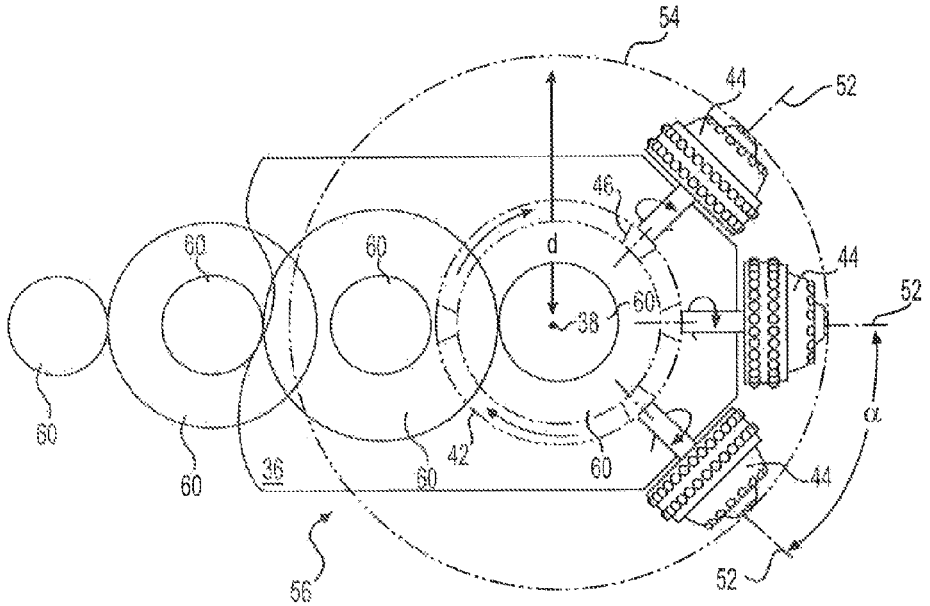
FIGS. 4 and 5 are cutaway side and top view illustrations, respectively, of an alternative exemplary core cutting assembly that may be used in conjunction with the continuous mining machine of FIG. 1.
Figure 5:
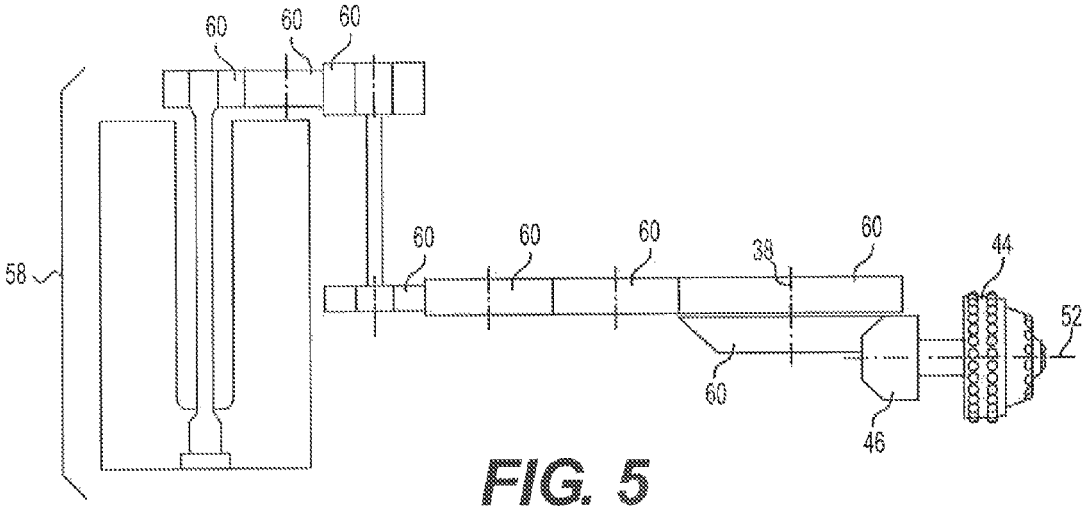

Because the core of material normally left behind at struts 36 may be completely removed with the disclosed core cutting assembly 40, a width of struts 36 may no longer be limited by an ability of CM 10 to break away the core. Accordingly, struts 36 may increase in width, providing additional strength and stability to milling system 12. In addition, the increased width of struts 36 may allow for alternative drive arrangements that have improved durability and/or efficiency. Such an alternative drive arrangement is depicted in FIGS. 4 and 5. Specifically, FIGS. 4 and 5 illustrate a core cutting assembly 56 having a parallel gear arrangement 58 instead of a drive shaft arrangement. This arrangement may have fewer directional shifts in power transfer, and thus improved durability and efficiency. Parallel gear arrangement 58 may include, for example, a series of gears (e.g., spur gears) 60 that intermesh with each other to transfer power from an electric motor 62 to pinion gear 46. This gear arrangement 58 may be used to power only core cutting assembly 56 or all of milling system 12, as desired.

INDUSTRIAL APPLICABILITY

The disclosed core cutting assembly may be applicable to any continuous mining machine having a milling drum that normally would leave behind a material core at one or more strut locations. The disclosed core cutting assembly may be positioned at these strut locations and used to fragment the material core. The core cutting assembly may fragment the material at the same radial distance and time as the milling drum, such that no core is formed. This may allow for the continuous mining machine to move forward substantially unimpeded.

Because the disclosed core cutting assembly may not allow for formation of a material core, the associated continuous mining machine may not be required to periodically break away the core in order to continue progressing forward. This may reduce a load on the continuous mining machine, allowing for increased production and efficiency. The reduced load could allow for a reduced power source size and a lighter-weight frame, thereby reducing a cost of the machine.

It will be apparent to those skilled in the art that various modifications and variations can be made to the disclosed continuous mining machine and core cutting assembly. Other embodiments will be apparent to those skilled in the art from consideration of the specification and practice of the disclosed machine and assembly. It is intended that the specification and examples be considered as exemplary only, with a true scope being indicated by the following claims and their equivalents.

What is claimed is:

1. A core cutting assembly for a mining machine having a milling drum, the core cutting assembly comprising:

a drive mechanism configured to rotate about a first axis of the milling drum; and at least one rotary cutting bit configured to remain in a fixed position relative to the first axis and powered by the drive mechanism to rotate about a second axis that is substantially orthogonal to the first axis.

2. The core cutting assembly of claim 1, further including a strut configured to support the milling drum, the drive mechanism, and the at least one rotary cutting bit, wherein the at least one rotary cutting bit is connected to a tip of the strut in a forward driving direction of the mining machine.

3. The core cutting assembly of claim 2, wherein the at least one rotary cutting bit includes three rotary cutting bits, each of the three rotary cutting bits arranged within a common plane.

4. The core cutting assembly of claim 3, wherein each of the three rotary cutting bits is spaced apart from an adjacent one of the three rotary cutting bits by about 45°.

5. The core cutting assembly of claim 1, further including a strut configured to support the milling drum, the drive mechanism, and the at least one rotary cutting bit, wherein a diameter of the at least one rotary cutting bit is larger than a width of the strut.

6. The core cutting assembly of claim 5, further including a shaft extending through the strut and configured to power the drive mechanism.

7. The core cutting assembly of claim 6, wherein the drive mechanism is a ring gear configured to mesh with a pinion gear of the at least one rotary cutting bit.

8. The core cutting assembly of claim 7, wherein the shaft is configured to also drive the milling drum.

9. The core cutting assembly of claim 5, further including a parallel gear arrangement disposed at least partially within the strut and configured to power the drive mechanism.

10. The core cutting assembly of claim 5, wherein:

the milling drum includes cutting tools mounted to an outer annular surface; and the at least one rotary cutting bit is configured to extend from the strut to at least an outer tip diameter of the cutting tools.

11. A milling system for a continuous mining machine, comprising:

a milling drum having an outer cylindrical surface divided into a plurality of segments;

a plurality of cutting tools mounted to the outer cylindrical surface of each of the plurality of segments;

a strut supporting the milling drum and being located axially between the plurality of segments;

a shaft connected to rotate the milling drum about a first axis;

a drive mechanism connected to the shaft at an end of the milling drum; and at least one rotary cutting bit connected to a tip of the strut and powered by the drive mechanism to rotate about a second axis that is substantially orthogonal to the first axis.

12. The milling system of claim 11, wherein the at least one rotary cutting bit is located forward of the strut relative to a driving direction of the continuous mining machine.

13. The milling system of claim 12, wherein:

the at least one rotary cutting bit includes three rotary cutting bits;

each of the three rotary cutting bits is arranged within a common plane; and each of the three rotary cutting bits is spaced apart from an adjacent one of the three rotary cutting bits by about 45.

14. The milling system of claim 11, wherein a diameter of the at least one rotary cutting bit is larger than a width of the strut.

15. The milling system of claim 11, wherein the at least one rotary cutting bit is configured to extend from the strut to at least an outer tip diameter of the plurality of cutting tools.

16. The milling system of claim 15, wherein:

the continuous mining machine includes a frame; and the milling system further includes a boom configured to pivotally connect the strut to the frame of the continuous mining machine.

17. The milling system of claim 11, wherein tips of the plurality of cutting tools that are located immediately adjacent the strut overhang the strut a distance.

18. The milling system of claim 17, wherein the tips of the plurality of cutting tools that are located immediately adjacent the strut overlap an edge of the at least one rotary cutting bit.

19. A continuous mining machine, comprising:

a frame;

a mobile undercarriage supporting the frame;

a boom pivotally connected to the frame;

a milling drum having an outer cylindrical surface divided into a plurality of segments, and a plurality of cutting tools mounted to each of the plurality of segments;

a strut located axially between the plurality of segments and connecting the milling drum to a distal end of the boom;

a shaft configured to drive the milling drum about a first axis;

a drive mechanism mounted to the strut and driven by the shaft to rotate about the first axis of the milling drum; and a plurality of rotary cutting bits arranged within a common plane, connected to a ti of the strut in a forward driving direction of the continuous mining machine, and powered by the drive mechanism to rotate about only a second axis that is substantially orthogonal to the first axis.

20. The continuous mining machine of claim 19, wherein:

a diameter of each of the plurality of rotary cutting bits is larger than a width of the strut;

the plurality of rotary cutting bits are each configured to extend from the strut to at least an outer tip diameter of the plurality of cutting tools; and tips of the plurality of cutting tools that are located immediately adjacent the strut overhang the strut a distance and overlap an edge of each of the plurality of rotary cutting bits.

* * * * *